US006295927B1

(12) United States Patent
Verschueren

(10) Patent No.: US 6,295,927 B1
(45) Date of Patent: Oct. 2, 2001

(54) LITHOGRAPHIC BASE FOR USE IN NON-IMPACT PRINTING

(75) Inventor: Eric Verschueren, Merksplas (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/409,882

(22) Filed: Oct. 1, 1999

Related U.S. Application Data

(60) Provisional application No. 60/112,072, filed on Dec. 14, 1998.

(30) Foreign Application Priority Data

Oct. 26, 1998 (EP) ..... 98203608

(51) Int. Cl.[7] ..... B41N 3/00
(52) U.S. Cl. ..... 101/462; 101/460
(58) Field of Search ..... 101/454, 455, 101/457, 458, 459, 460, 462

(56) References Cited

U.S. PATENT DOCUMENTS

| | | | | |
|---|---|---|---|---|
| 2,805,621 | | 9/1957 | Pickrel | 101/462 |
| 2,941,466 | | 6/1960 | Newman et al. | 101/460 |
| 3,230,873 | | 1/1966 | Ort | 101/462 |
| 3,971,660 | * | 7/1976 | Staehle | 101/455 |
| 4,046,946 | | 9/1977 | Shaw | 101/460 |
| 4,284,705 | * | 8/1981 | Phlipot et al. | 430/302 |
| 4,851,150 | | 7/1989 | Hench et al. | 264/12 |
| 5,254,421 | * | 10/1993 | Coppens et al. | 101/465 |
| 5,402,725 | * | 4/1995 | Vermeersch et al. | 101/453 |
| 5,462,833 | * | 10/1995 | Hauquier et al. | 101/456 |
| 6,105,500 | * | 8/2000 | Bhambra et al. | 101/459 |

* cited by examiner

*Primary Examiner*—Stephen R. Funk
(74) *Attorney, Agent, or Firm*—Breiner & Breiner, L.L.C.

(57) ABSTRACT

According to the present invention there is provided a lithographic base including a support and a hydrophilic cross-linked layer having a total volume of pores of more than 0.0007 $cm^3/g$ of the lithographic base. The hydrophilic cross-linked layer contains a hydrophilic binder, $TiO_2$ particles and a low molecular weight polyhydric alcohol or a liquid amide as a drying control chemical additive.

7 Claims, No Drawings

LITHOGRAPHIC BASE FOR USE IN NON-IMPACT PRINTING

This application claims benefit to provisional application No. 60/112,072 filed Dec. 14, 1998.

FIELD OF THE INVENTION

The present invention relates to a lithographic base. More particularly the present invention relates to a hydrophilic lithographic surface layer with improved mechanical properties.

BACKGROUND OF THE INVENTION.

Lithography is the process of printing from specially prepared surfaces, some areas of which are capable of accepting lithographic ink, whereas other areas, when moistened with water, will not accept the ink. The areas which accept ink form the printing image areas, generally hydrophobic areas, and the ink-rejecting areas form the background areas, generally hydrophilic areas.

In the art of photolithography, a photographic material is made imagewise receptive to oily or greasy inks in the photo-exposed (negative-working) or in the non-exposed areas (positive-working) on a hydrophilic background.

In the production of common lithographic printing plates, also called surface litho plates or planographic printing plates, a lithographic base that has affinity to water or obtains such affinity by chemical treatment is coated with a thin layer of a photosensitive composition. Compositions for that purpose include light-sensitive materials such as light-sensitive polymers, diazonium salts or resins, a photoconductive layer, a silver halide emulsion etc. These materials are then image-wise exposed to actinic radiation and processed in the appropriate manner so as to obtain a lithographic printing plate.

In another embodiment, a silver precipitating (nucleating) agent is located in or on top of the hydrophilic surface. An image is obtained on the precipitating layer according to the silver salt diffusion transfer process by contacting said precipitating layer with an exposed silver halide emulsion in the presence of a silver halide developing agent and a silver halide solvent.

According to another embodiment there is provided a heat mode imaging element for making a lithographic printing plate comprising on a lithographic base with a hydrophilic surface a first layer including a polymer, soluble in an aqueous alkaline solution and a top layer on the same side of the lithographic base as the first layer which top layer is IR-sensitive and unpenetrable for an alkaline developer wherein said first layer and said top layer may be one and the same layer.

A hydrophilic receiving layer can also be used for xerography, electrography, thermosublimation, thermal transfer and other image-forming techniques.

Several types of supports can be used for the manufacturing of a lithographic imaging printing plate. Common supports are for example organic resin supports, e.g. polyesters, and paper bases, e.g. polyolefin coated paper. These supports are first coated with a hydrophilic layer forming the hydrophilic lithographic background of the printing plate.

It is known to use as hydrophilic layer in these systems a layer containing polyvinyl alcohol and hydrolyzed tetra(m) ethyl orthosilicate and titanium dioxide and preferably also silicium dioxide as described in e.g. GB-P-1 419 512, FR-P-2 300 354, U.S. Pat. Nos. 3,971,660 and 4,284,705, EP-A-405,016 and 450 199.

To obtain superior physical properties, it is very important to control the drying process. Avoiding drying stress results in materials with superior physical qualities. In fact, drying stresses, caused by the pressure gradient in the liquid phase, result in the occurrence of microscopic fractures. The exterior of the gel shrinks much faster than the interior so that tensile stresses arise that tend to fracture the network at the exterior. These fractures propagate easily during the further drying process.

A number of measures can be taken to avoid these defects. To obtain good results, aging the gel before drying is recommended. However this is uneconomical and industrially not feasible.

OBJECTS OF THE INVENTION

It is an object of the invention to provide a hydrophilic layer, for use in a printing system with excellent physical properties.

It is further an object of the present invention to provide a hydrophilic layer which can be coated economically.

Further objects of the present invention will become clear from the description hereinafter.

SUMMARY OF THE INVENTION

According to the present invention there is provided a lithographic base comprising a support and a hydrophilic layer thereon containing a hydrophilic binder, $TiO_2$ particles and wherein said layer is cross-linked, characterized in that the total volume of pores of said lithographic base is more than 0.0007 $cm^3/g$.

DETAILED DESCRIPTION OF THE INVENTION

Preferably the total volume of pores of said lithographic base is at least 0.0010 $cm^3/g$.

According to the present invention, the lithographic base having a hydrophilic surface comprises a flexible support, such as plastic film, provided with a cross-linked hydrophilic layer. A particularly suitable cross-linked hydrophilic layer may be obtained from a hydrophilic binder cross-linked with a cross-linking agent such as formaldehyde, glyoxal, polyisocyanate, zirconium compounds, titanates or a hydrolyzed tetra-alkylortho-silicate. The latter is particularly preferred.

As hydrophilic binder there may be used hydrophilic (co)polymers or mixtures such as for example, homopolymers and copolymers of vinyl alcohol,polyvinyl pyrrolidone,starch or modified starch, acrylamide, methylol acrylamide, methylol methacrylamide, acrylate acid, methacrylate acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60 percent by weight, preferably 80 percent by weight.

The amount of crosslinking agent, in particular of tetraalkyl orthosilicate, is preferably at least 0.2 parts by weight per part by weight of hydrophilic binder, more preferably between 0.5 and 5 parts by weight, most preferably between 0.8 parts by weight and 3 parts by weight.

A cross-linked hydrophilic layer in a lithographic base used in accordance with the present embodiment preferably also contains substances that increase the mechanical strength and the porosity of the layer. For this purpose colloidal silica may be used. The colloidal silica employed may be in the form of any commercially available water-dispersion of colloidal silica for example having an average particle size up to 40 nm, e.g. 20 nm.

A cross-linked hydrophilic layer in a lithographic base used in accordance with the present embodiment also contains in addition inert particles of larger size than the colloidal silica i.e. particles having an average diameter of at least 100 nm which are particles of titanium dioxide. By incorporating these particles the surface of the cross-linked hydrophilic layer is given a uniform rough texture consisting of microscopic hills and valleys, which serve as storage places for water in background areas. The amount of titanium dioxide is at least 55%, more preferably at least 62% of the total amount of the hydrophilic layer.

The weight of a cross-linked hydrophilic layer in a lithographic base in accordance with this embodiment may vary in the range of 0.2 to 25 g/m$^2$ and is preferably 1 to 15 g/m$^2$ .

As flexible support of a lithographic base in connection with the present embodiment paper or polyolefin paper can be used. It is particularly preferred to use a plastic film e.g. subbed polyethylene terephthalate film, subbed polyethylene naphthalate film, cellulose acetate film, polystyrene film, polycarbonate film etc . . . . The plastic film support may be opaque or transparent.

It is particularly preferred to use a polyester film support to which an adhesion improving layer has been provided. Particularly suitable adhesion improving layers for use in accordance with the present invention comprise a hydrophilic binder and colloidal silica as disclosed in EP-A-619 524, EP-A-620 502 and EP-A-619 525. Preferably, the amount of silica in the adhesion improving layer is between 200 mg per m$^2$ and 750 mg per m$^2$. Further, the ratio of silica to hydrophilic binder is preferably more than 1 and the surface area of the colloidal silica is preferably at least 300 m$^2$ per gram, more preferably at least 500 m$^2$ per gram.

The hydrophilic layer also contains drying control chemical additives.(DCCA's) As DCCA following classes of chemical compounds can be used:

- low molecular weight polyhydric alcohols such as ethylene glycol, diethylene glycol, triethylene glycol, tetraethylene glycol, dipropylene glycol, propylene glycol, pentane diol, glycerol, butane triol, trimethylolpropane, pentaerythritol, dipentaerythritol, 1-monoacetylglycerol and so on;
- liquid amides such as formamide, acetamide, propanamide and so on.

Said DCCA's can be used in combination and are preferably used in an amount between 100 and 1500 mg/m$^2$. Solid acids should be excluded.

Said hydrophilic layer is suitable for heat mode imaging elements, ink let printing, electrostatic printing, thermal transfer printing, laser ablation transfer, thermal ablation transfer, laser transfer printing, electrographic printing, pen plotter, manual writing, xerographic printing, tonerjet printing.

EXAMPLE 1

Comparative Example

A 0.175 mm thick polyester foil was coated with a layer from a 23.6% aqueous solution at pH 4, with a wet coating thickness of 50 $\mu$m. This layer was after chilling for 30 sec at 10° C. dried at a temperature of 50° C. with a moisture content of the air of 4 g/m$^3$ for at least 3 minutes.

The resulting hydrophilic layer contained 8990 mg/m$^2$ $TiO_2$, 900 mg/m$^2$ $SiO_2$ , 990 mg/m$^2$ polyvinylalcohol, 81.6 mg/m$^2$ SAPONIN™, 36.8 mg/m$^2$ of HOSTAPON T™ and 605 mg/m$^2$ of FT248 ™.

In advance to the preparation of the coating solution a dispersion was made comprising the above mentioned $TiO_2$, $SiO_2$ and polyvinylalcohol.

$TiO_2$ with average particle size between 0.3 and 0.5 $\mu$m was used. The used polyvinyl alcohol is hydrolyzed polyvinyl acetate, commercially available at Wacker Chemie GmbH, Germany under the trademark POLYVIOL WX™. The $SiO_2$ mentioned above is added as a dispersion of hydrolyzed tetramethyl orthsilicate to the dispersion. SAPONIN is a nonionic surfactant mixture consisting of esters and polyglycosides, commercially available at Merck. HOSTAPON T is an anionic surfactant, commercially available at Hoechst AG. FT248 is an anionic perfluoro surfactant, commercially available at Bayer AG.

EXAMPLE 2

The same composition was prepared in the same way as that described in example 1, with the exception that the hydrophilic layer comprised also 90.0 mg/m$^2$ of glycerol.

EXAMPLE 3

The same composition was prepared in the same way as that described in example 1, with the exception that the hydrophilic layer comprised also 250.0 mg/m$^2$ of glycerol.

EXAMPLE 4

The same composition was prepared in the same way as that described in example 1, with the exception that the hydrophilic layer comprised also 500.0 mg/m$^2$ of glycerol.

EXAMPLE 5

The same composition was prepared in the same way as that described in example 1, with the exception that the hydrophilic layer comprised also 90.0 mg/m$^2$ of glycerol and 100 mg/m$^2$ of acetamide.

EXAMPLE 6

The same composition was prepared in the same way as that described in example 1, with the exception that the hydrophilic layer comprised also 90.0 mg/m$^2$ of glycerol and 200 mg/m$^2$ of acetamide.

EXAMPLE 7

The same composition was prepared in the same way as that described in example 1, with the exception that the hydrophilic layer comprised also 460.0 mg/m$^2$ of glycerol and 100 mg/m$^2$ of acetamide.

EXAMPLE 8

The same composition was prepared in the same way as that described in example 1, with the exception that the hydrophilic layer comprised also 460.0 mg/m$^2$ of glycerol and 100 mg/m$^2$ of acetamide.

EXAMPLE 9

The same composition was prepared in the same way as that described in example 1, with the exception that the hydrophilic layer comprised also 460.0 mg/m$^2$ of glycerol and 1000 mg/m$^2$ of acetamide.

EXAMPLE 10

The same composition was prepared in the same way as that described in example 1, with the exception that the hydrophilic layer comprised also 90.0 mg/m$^2$ of glycerol and 560 mg/m$^2$ of oxalic acid.

EXAMPLE 11

The same composition was prepared in the same way as that described in example 1, with the exception that the hydrophilic layer comprised also 90.0 mg/m$^2$ of glycerol and 1130 mg/m$^2$ of oxalic acid.

The total pore volume of the lithographic base was measured by a Micromeritics ASAP 2400 apparatus. Therefore, the material, including the support, was cut into little pieces and brought into the apparatus, then a sorption/desorption of the material was measured with nitrogen gas as adsorbate.

From the obtained sorption/desorption isotherm, the total pore volume was calculated by the method of Barett, Joyner and Hallender.

Physical Properties

The physical properties of the imaging element were evaluated by measuring the scratch resistance. In this test the mechanical properties and the adhesion of the coating to the support become clear.

Scratching the Hydrophilic Layer.

The above mentioned materials in comparative example 1 and examples 2 through 11 were scratched in a standard test. First, swelling of the lithographic base in distilled water occurred under equilibrium conditions. For safety, a time of 2 minutes was applied. In this test scratches were formed by displacing needles at a speed of 96 cm/min, under well defined loads. The needles were of type rubin with a radius of 1.5 mm. 15 scratches were formed under following loads: 57-85-114-142-170-113-169-225-282-338-400-600-800-1000 en 1200 mN.

Evaluation of the scratch resistance of the hydrophilic layer. The 15 scratches were controlled on width of damage and given a corresponding quotation as indicated in table 1.

When the depth of the scratch was unto the support, this means the total layer was removed, an extra value was summated. This phenomenon was visible by a discoloration from white to transparent on the scratch region. This value was 3 when the discoloration was locally. When the entire scratch was transparent a value of 5 was added.

TABLE 1

| Quotation | Width of scratch |
|---|---|
| 0 | no scratch visibie |
| 0.5 | scratch smaller than 50 $\mu$m |
| 1 | width between 50 and 100 $\mu$m |
| 2 | width between 100 and 150 $\mu$m |

TABLE 1-continued

| Quotation | Width of scratch |
|---|---|
| 3 | width between 150 and 200 $\mu$m |
| 4 | width greater than 200 $\mu$m |
| +3 | when scratch is broken transparent line |
| +5 | when scratch is fully transparent |

A summation of all given quotations resulted in the scratch resistance of the material. The lower the value, the better the scratch resistance.

| | Scratch resistance | Total pore volume in cm$^3$/g |
|---|---|---|
| Example 1 | 38 | 0.000101 |
| Example 2 | 11 | 0.000087 |
| Example 3 | 0 | 0.000768 |
| Example 4 | 0 | 0.001067 |
| Example 5 | 0 | 0.000790 |
| Example 6 | 0 | 0.001612 |
| Example 7 | 3 | 0.000912 |
| Example 8 | 0 | 0.001272 |
| Example 9 | 0 | 0.001872 |
| Example 10 | 31 | 0.000070 |
| Example 11 | 11 | 0.000079 |

It is clear from the results of table 2 that all the examples according to the invention have a very good to excellent scratch resistance, much better than the comparative example.

What is claimed is:

1. A lithographic base comprising a support and a hydrophilic cross-linked layer having a total volume of pores of more than 0.0007 cm$^3$/g of said lithographic base, the hydrophilic cross-linked layer containing a hydrophilic binder, $TiO_2$ particles and a low molecular weight polyhydric alcohol or a liquid amide as drying control chemical additive.

2. A lithographic base according to claim 1 wherein the total volume of pores of said lithographic base is at least 0.0010 cm$^3$/g.

3. A lithographic base according to claim 1 wherein the low molecular weight polyhydric alcohol comprises glycerol.

4. A lithographic base according to claim 1 wherein the liquid amide is acetamide.

5. A lithographic base according to claim 1 wherein the drying control chemical additive is present in an amount between 100 and 1500 mg/m$^2$.

6. A lithographic base according to claim 1 wherein the hydrophilic layer has a weight between 1 and 15 g/m$^2$.

7. A lithographic base according to claim 1 wherein the titanium oxide is used in an amount of at least 55% of the total amount of the hydrophilic layer.

* * * * *